US009269209B2

(12) United States Patent
Dietz et al.

(10) Patent No.: US 9,269,209 B2
(45) Date of Patent: Feb. 23, 2016

(54) APPARATUS FOR TRANSPORTING AND/OR STORING BANKNOTES

(75) Inventors: Oliver Dietz, Borchen (DE); Andre Michels, Borgentreich (DE); Sascha Ringel, Paderborn (DE)

(73) Assignee: Wincor Nixdorf International GmbH (DE)

( * ) Notice: Subject to any disclaimer, the term of this patent is extended or adjusted under 35 U.S.C. 154(b) by 554 days.

(21) Appl. No.: 13/643,918

(22) PCT Filed: May 5, 2011

(86) PCT No.: PCT/EP2011/057221

§ 371 (c)(1), (2), (4) Date: Nov. 5, 2012

(87) PCT Pub. No.: WO2011/138406

PCT Pub. Date: Nov. 10, 2011

(65) Prior Publication Data

US 2013/0036951 A1 Feb. 14, 2013

(30) Foreign Application Priority Data

May 5, 2010 (DE) ..... 10 2010 016 807

(51) Int. Cl.

| | |
|---|---|
| ***E05G 1/14*** | (2006.01) |
| ***G07D 11/00*** | (2006.01) |
| ***B65H 29/00*** | (2006.01) |
| *E05G 1/12* | (2006.01) |

(52) U.S. Cl.

CPC ..... *G07D 11/0006* (2013.01); *B65H 29/006* (2013.01); *B65H 2301/41912* (2013.01); *E05G 1/12* (2013.01); *E05G 1/14* (2013.01)

(58) Field of Classification Search

CPC ..... E05G 1/12; E05G 1/14; G07D 11/0006; G07D 11/0009; G07D 11/0012; G07D 11/0042; B65H 29/006; B65H 2301/41912

USPC ..... 109/25, 29–34

See application file for complete search history.

(56) References Cited

U.S. PATENT DOCUMENTS

| | | | | |
|---|---|---|---|---|
| 6,497,186 | B1 * | 12/2002 | Lundblad | 109/25 |
| 6,553,922 | B1 * | 4/2003 | Lundblad et al. | 109/25 |
| 7,151,324 | B2 * | 12/2006 | Neuhoff et al. | 307/10.2 |
| 8,171,865 | B2 * | 5/2012 | Lindskog et al. | 109/25 |

(Continued)

FOREIGN PATENT DOCUMENTS

| | | | |
|---|---|---|---|
| CN | 101147176 | A | 3/2008 |
| DE | 10-2008-011404 | A1 | 9/2009 |

(Continued)

OTHER PUBLICATIONS

International Search Report (in German with English translation) and Written Opinion (in German) for PCT/EP2011/057221, mailed Sep. 22, 2011; ISA/EP.

(Continued)

*Primary Examiner* — Lloyd Gall

(74) *Attorney, Agent, or Firm* — Harness, Dickey & Pierce, P.L.C.

(57) ABSTRACT

The invention relates to a device (20) for transport and/or storage of notes of value. The device (20) comprises a roller storage (20) having a winding drum (1, 30). Further, the device (20) comprises a sensor (26, 34) for detecting a rotary motion of the winding drum (1, 30).

15 Claims, 5 Drawing Sheets

(56) References Cited

U.S. PATENT DOCUMENTS

| | | | | |
|---|---|---|---|---|
| 8,181,766 | B2 | 5/2012 | Michels | |
| 8,186,673 | B2 * | 5/2012 | Michels | 271/209 |
| 8,413,919 | B2 * | 4/2013 | Michels | 242/528 |
| 2002/0170473 | A1 * | 11/2002 | Fettis et al. | 109/23 |
| 2006/0162628 | A1 * | 7/2006 | Lindskog | 109/25 |
| 2006/0214350 | A1 | 9/2006 | Saltsov et al. | |
| 2010/0072220 | A1 | 3/2010 | Michels | |
| 2010/0116839 | A1 | 5/2010 | Michels | |
| 2010/0117844 | A1 | 5/2010 | Brexel et al. | |
| 2010/0133289 | A1 | 6/2010 | Michels | |
| 2010/0194569 | A1 * | 8/2010 | Lindskog | 340/568.7 |
| 2011/0017766 | A1 | 1/2011 | Michels et al. | |
| 2011/0042889 | A1 | 2/2011 | Holland-Letz et al. | |
| 2011/0181416 | A1 | 7/2011 | Dietz et al. | |
| 2012/0205221 | A1 | 8/2012 | Michels et al. | |
| 2012/0217130 | A1 | 8/2012 | Michels et al. | |
| 2012/0323361 | A1 * | 12/2012 | Brexel et al. | 700/236 |
| 2013/0055931 | A1 * | 3/2013 | Dietz | 109/25 |

FOREIGN PATENT DOCUMENTS

| | | | |
|---|---|---|---|
| DE | 10-2008-038801 | A1 | 2/2010 |
| EP | 0726547 | A2 | 8/1996 |
| EP | 0795842 | A2 | 9/1997 |
| EP | 1566513 | A2 | 8/2005 |
| WO | WO-0129786 | A1 | 4/2001 |
| WO | WO-2006-041358 | A1 | 4/2006 |
| WO | WO-2007-037745 | A1 | 4/2007 |
| WO | WO-2008-110893 | A2 | 9/2008 |

OTHER PUBLICATIONS

International Preliminary Report on Patentability for PCT/EP2011/057221 mailed Nov. 15, 2012 with English translation (14 pages).

* cited by examiner

APPARATUS FOR TRANSPORTING AND/OR STORING BANKNOTES

CROSS-REFERENCE TO RELATED APPLICATIONS

This application is a National Stage of International Application No. PCT/EP2011/057221, filed May 5, 2011, and published in German as WO 2011/138406 A1 on Nov. 10, 2011. This application claims the benefit and priority of German Application No. 10 2010 016 807.6, filed May 5, 2010. The entire disclosures of the above applications are incorporated herein by reference.

BACKGROUND

This section provides background information related to the present disclosure which is not necessarily prior art.

TECHNICAL FIELD

The invention relates to a device for transport and/or storage of notes of value. The device comprises a roller storage for storing the notes of value, the roller storage comprising a winding drum on which the notes of value can be wound for storage.

DISCUSSION

From the unpublished patent application No. DE 10 2008 038 801 a transportable roller storage is known which is designed in the form of a cash box and is used, for example, in automated teller machines, automatic cash register systems and/or automatic cash safes.

In known cash boxes, position sensors, acceleration sensors and/or shock sensors are used in order to protect the banknotes received in the cash box from manipulation, in particular from theft. For this purpose, the cash box comprises a so-called ink kit which is triggered if at least one of the above sensors exceeds a preset threshold value, and thus if a manipulation attempt is assumed to have been made. If the ink kit is triggered a dyestuff inside the cash box is released so that at least part, preferably all of the banknotes present inside the cash box are dyed at least partially. The use of the acceleration, position and/or shock sensors, however, bears a problem in that the ink kit often is triggered by them by mistake during transport of the cash box although no manipulation attempt at all was made. The ink kit is triggered, for example when the cash box has accidentally been dropped; consequently the notes of value received in the cash box are needlessly irreversibly invalidated. Thereby, as well as for cleaning the cash box and replacing the ink kit great expenditure of time and money is incurred.

One possibility of avoiding such needless triggering of the ink kit during transport of the cash box is switching the cash box during transport to a transport mode where the acceleration, position and/or shock sensors are deactivated and consequently do not trigger when a preset threshold value is exceeded. This bears the problem that manipulation attempts and/or manipulation of the cash box are made easier, and therefore security of the banknotes received in the cash box is decreased.

SUMMARY OF THE INVENTION

It is an object of the invention to specify a device for transport and/or storage of notes of value wherein manipulation attempts are detected and avoided reliably and securely.

With the provision a sensor for detecting a rotary motion of the winding drum it is achieved that a rotary motion of the winding drum can be detected reliably and securely any time. In order to access the notes of value which are wound on the winding drum by means of a film or a belt and which are thus stored in the roller storage, the winding drum inevitably must be rotated. Cutting the film involves a high effort and usually leads to damaging of the value notes wound to the drum, so that they are rendered unusable. Hence, an attempt to manipulate the roller storage requires rotating the winding drum, in order to access the banknotes. If in this case a rotary motion of the winding drum is detected by means of the sensor, and if the device is not in mode allowing a rotary motion, it can be assumed that a manipulation attempt is made, and the corresponding steps can be started which prevent the person responsible for the manipulation from putting the unlawfully gained notes of value in circulation.

It is advantageous if the winding drum is supported by a shaft so as to be rotatable about the longitudinal axis of said shaft, and if the sensor detects a rotary motion of said shaft. Because the winding drum and the shaft supporting the winding drum are connected to rotate with each other, a rotary motion of the shaft inevitably results in a rotary motion of the winding drum so that via the rotary motion of the shaft which is easy to detect also a rotary motion of the winding drum can be reliably detected. Alternatively, the winding drum can be connected to the shaft in a form-locked manner, e.g. by means of a gear mechanism.

In particular, the device comprises an invalidating unit for invalidating the notes of value stored in the roller storage and a control unit for controlling said invalidating unit. The invalidating unit in turn preferably comprises an ink kit for irreversibly dyeing the stored notes of value with a dyestuff so that the notes of value cannot be utilized any longer and are thus of no use for a potential thief.

The control unit triggers the invalidating unit in particular if a rotary motion of the winding drum has been detected by means of the sensor. Triggering the invalidating unit means that the notes of value stored are rendered invalid by means of the invalidating unit. If the invalidating unit is an ink kit, triggering the invalidating unit means that the ink kit dyes the stored notes of value.

In a preferred embodiment of the invention the control unit does trigger the invalidating unit in an activated mode if the sensor has detected a rotary motion of the winding drum, and does not trigger the invalidating unit in a deactivated mode if the sensor has detected a rotary motion of the winding drum. The deactivated mode is in particular the mode of the device that is used if the device is received in a device for handling notes of value, in particular an automated teller machine, an automatic cash register system and/or an automatic cash safe. In this deactivated mode, a rotary motion of the winding drum is allowed because the winding drum necessarily must be rotated when notes of value are deposited into and/or dispensed from the device for handling notes value, and the rotation of the winding drum for storing and/or dispensing the notes of value is desired. The deactivated mode is also referred to as the ATM (automated teller machine) mode.

The activated mode is in particular the mode that is activated during transport of the device, i.e. when the device is not received in a device for handling notes of value. During transport, rotary motion of the winding drum is not desired since notes of value are not supposed to be deposited into and/or dispensed from the roller storage during transport. Therefore, if a rotary motion of the winding drum occurs during transport it can be assumed that an attempt is made to unauthorized removal of notes of value, i.e. that a manipulation attempt is made. Hence, the invalidating unit is triggered in the activated mode if the sensor detects a rotary motion. For this reason the activated mode is referred to as the transport mode.

Via switching between the activated and the deactivated mode it is achieved that the invalidating unit is not triggered erroneously if the device for transport and/or storage of notes of values is received in a device for handling notes of values by means of which notes of values are to be supplied to or removed from the roller storage.

Alternatively, the sensor can be set to a deactivated mode if the device for transport and/or storage of notes of value is received in a device for handling notes of value so that no information is transmitted from the sensor to the control unit in this deactivated mode so that the control unit does not trigger the invalidating unit even if a rotary motion of the winding drum occurs.

In a particularly preferred embodiment of the invention the control unit triggers the invalidating unit only if the sensor detects a rotary motion of the winding drum in an unwinding direction. Here, the unwinding direction is the direction of the winding to which the winding drum is to be rotated for removal of notes of value. Thereby it is achieved that the invalidating unit is triggered only if notes of value are actually removed from the roller storage, but is not triggered if the winding drum is rotated in a manner that only supply of notes of value to the roller storage is possible.

Moreover, it is advantageous if the device comprises a position sensor for detecting a change in orientation of the device, an acceleration sensor for detecting acceleration of the device, and/or a shock sensor for detecting shock-like loads acting on the device. Further, the device includes a memory element having a memory area wherein a preset maximum permissible threshold value for the change in orientation, a threshold value for acceleration, and/or a threshold value for shock-like load are stored. After detection of a change in orientation, an acceleration, and/or a shock-like load, the control unit compares the values determined by means of the sensor or the sensors with the respective threshold values and stores data containing information thereon into a memory area of a memory element if at least one of the values determined by means of the sensors exceeds the corresponding threshold. The control unit triggers the invalidating unit if the sensor detects a rotary motion of the winding drum within a preset period after the threshold has been exceeded. Thereby it is achieved that erroneous triggering of the invalidating unit during transport of the device is avoided or at least reduced. Actually, the invalidating unit is triggered only in the event that not only at least one threshold value is exceeded but in addition a rotary motion of the winding drum occurs so that the invalidating unit is not triggered if, for example, the device is accidentally dropped by a security transport staff member.

In a particularly preferred development of the invention the preset period is a first period. The control unit triggers the invalidating unit only if the control unit has determined that at least one threshold value has been exceeded within a preset second period of time with a preset frequency. Thereby it is achieved that the invalidating unit is not triggered when one of the threshold values has been exceeded only once or only a few times, so that the number of erroneous triggerings is reduced. Here it is assumed that, for example, for destroying the device the threshold values must be exceeded with the preset frequency in order to mechanically damage the device so the notes of value are accessible.

The sensor in particular comprises a Hall sensor, wherein preferably at least one magnet is fixed for rotation with the winding drum's shaft so that a rotary motion of the shaft and thus of the winding drum is detectable by means of the Hall sensor.

The device comprises in particular a cash box in which the roller storage and the sensor are received. Formation of the device as a cash box allows for simple handling of the roller storage so that a transportable roller storage which is transportable between automated teller machines, automatic cash register systems and/or automatic cash safes and a cash center is achieved in a simple manner.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
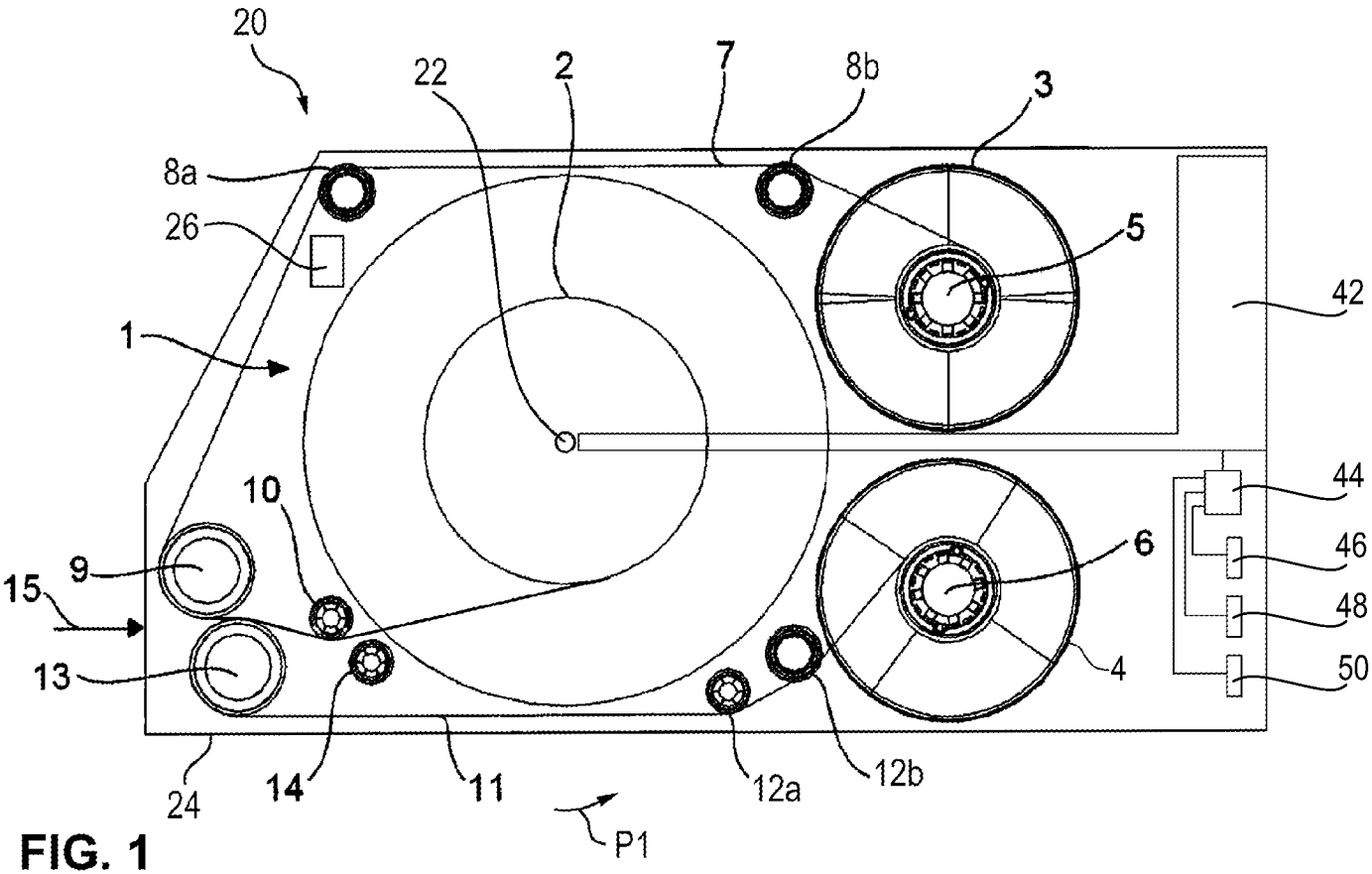
FIG. 1 is a schematic illustration of a transportable roller storage.

In FIG. 1, a schematic illustration of a device for transport and/or storage of notes of value formed as a transportable roller storage 20 is shown. The transportable roller storage 20 comprises a winding drum 1 having a winding core 2. The outer circle around the winding core schematically indicates the circumference of the winding drum 1 in a state filled to a maximum. The winding drum 1 is in particular supported on a shaft 22 so as to be rotatable about the longitudinal axis of the shaft 22, with the winding drum 1 being connected with the shaft 22 in a rotatably fixed and/or form-locked manner. The shaft 22 is also referred to as main shaft and is preferably driven by a driving unit.

Further, the transportable roller storage 20 comprises two film drums 3, 4 which are arranged on driving shafts 5 and 6, respectively. The driving shafts 5, 6 can be driven by one or two motors (not shown). Alternatively, all the shafts 5, 6, and 22 can be driven via a central driving unit.

A first film belt 7 is wound on the first film drum 3 and a second film belt 11 is wound on the second film drum 4. The film belts 7, 11 are guided across a plurality of rollers 8*a*, 8*b*, 9, 10, 12*a*, 12*b*, 13, 14.

The notes of value to be stored in the roller storage 20 are guided in direction of the arrow 15 through an opening (not shown) of a housing 24 into a supply area formed between the two rollers 9 and 13. In the supply area, a supplied note of value is first caught by the first film belt 7 and is subsequently contacted by the second film belt 11 which is guided around the roller 13. This delayed contact is due to an offset between the rollers 9 and 13. Behind roller 13, as seen in supply direction, the first film belt 7 and the second film belt 11 are pressed against each other, whereby the notes of value arranged between them are held. Then, the two film belts 7, 11, together with the notes of value arranged between them, are wound onto the winding drum 1 in supply direction P1.

In the reverse case, notes of value stored on the winding drum 1 are unwound by unwinding the two film belts 7, 11 in the unwinding direction opposite to arrow P1 so that the notes of value can be removed.

Furthermore, the roller storage 20 comprises a sensor 26 for detecting a rotary motion of the winding drum 1. The sensor 26 is in particular designed so that a rotary motion of the main shaft 22 is detectable by the sensor. Alternatively, or in addition, a rotary motion of the winding drum 1 can also directly be detected by means of the sensor 26.

Moreover, the roller storage 20 includes an ink kit 42 and a control unit 44 for controlling the ink kit 42. The ink kit 42 serves for invalidating the notes of value stored in the roller storage 20 in case of a manipulation attempt. For this purpose, the control unit 44 triggers the ink kit 42 in case of a manipulation attempt, whereby the notes of value are irreversibly dyed by the ink kit's dyestuff and are thus of no use for a potential thief.

If the sensor 26 detects a rotary motion of the winding drum 1 it transmits data with information thereon to the control unit 44 which in response triggers the ink kit 42 if an activated mode is set. On the other hand, if a deactivated mode is set the control unit does not trigger the ink kit 42 even if a rotary motion of the winding drum 1 is detected. The deactivated mode is set in particular if the transportable roller storage 20 is received in an automated teller machine, an automatic cash register system, an automatic cash safe, and/or a so-called docking station in which the roller storage 20 is supplied with notes of values and/or emptied, because in this case the winding drum 1 must be rotated for removal and/or supply of notes of value.

In a preferred embodiment of the invention the control unit 44 triggers the ink kit 42, even in the activated mode, only if a rotary motion in unwinding direction is determined. If, however, a rotary motion of the winding drum 1 in supply direction P1 is determined the ink is not triggered.

Via detection of a rotary motion of the winding drum 1 and possible triggering of an ink kit 42 it is achieved that manipulation attempts are effectively prevented. Even if a potential thief manages to overcome other sensors which are possibly present, such as a position sensor 46, an acceleration sensor 48, a shock sensor 50, or a sensor for detecting whether a cover of the roller storage 20 has been opened, this person must in any case rotate the winding drum 1 in unwinding direction in order to access the notes of values.

In an alternative embodiment of the invention the roller storage 20 in addition to the sensor 26 comprises a position sensor 46 for detecting a change in orientation of the roller storage 20, an acceleration sensor for detecting an acceleration of the roller storage 20 and/or a shock sensor 50 for detecting a shock-like load acting on the roller storage 20. If at least one of these sensors 26, 46, 48, 50 determines that a preset threshold value has been exceeded, the ink kit 42, in contrast to known transportable roller storages 20, is not directly triggered, but is triggered only if after the at least one threshold value has been exceeded a rotary motion of the winding drum 1 is detected by means of the sensor 26. This way, the number of false triggering events, i.e. the number of those events of triggering the ink kit 42 which were unnecessary because no manipulation attempt was made is reduced. This in turn saves expenditure of time and money.

Figure 2:
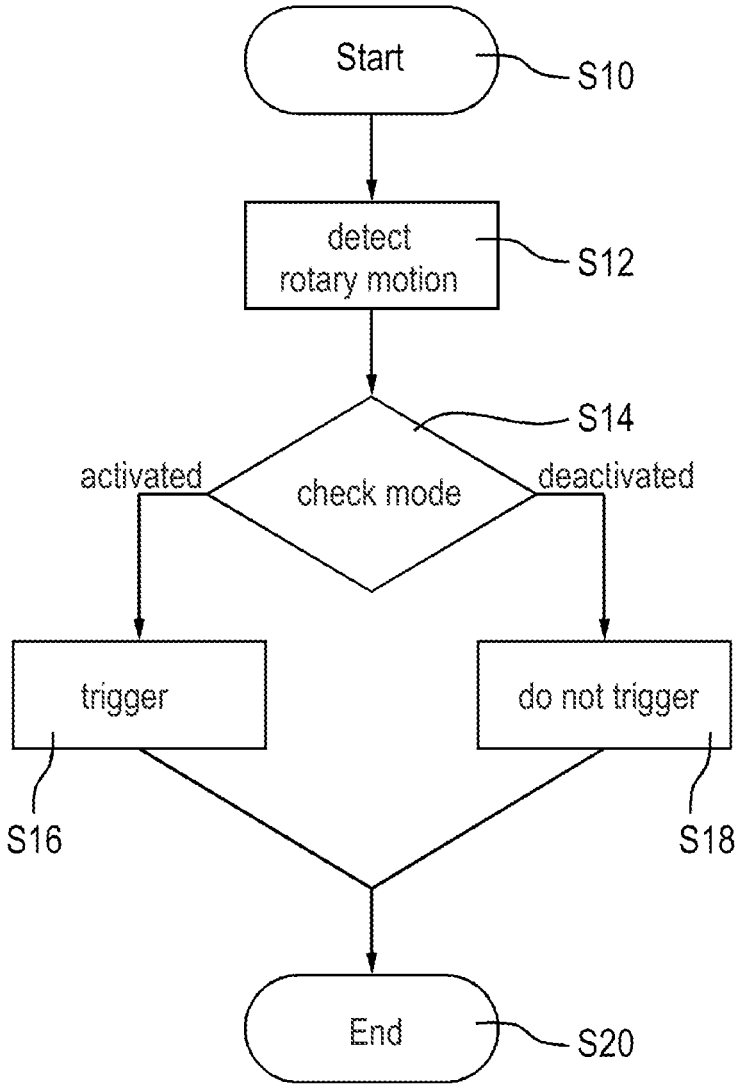
FIG. 2 is a flow chart of the control of an invalidating unit of the transportable roller storage according to FIG. 1.

FIG. 2 shows a flow chart of the control of the ink kit 42 of the roller storage 20 via the control unit 44. The process starts in step S10.

If in step S12 a rotary motion of the winding drum 1 is detected by means of the sensor 26, it is subsequently determined in step S14 which mode is set. If it is determined that the activated mode is set the control unit 44 triggers the ink kit 42 in step S16. On the other hand, if it is determined that the deactivated mode is set the control unit 44 does not trigger the ink kit 42 in step S18. Subsequently, the process is ended in step S20.

In an alternative embodiment of the invention it can likewise first be determined which mode is set. If the deactivated mode is set the sensor 26 is deactivated so that no rotary motion at all is detected by means of the sensor 26 any longer. The sensor 26 remains in the activated state only in the activated mode so that in this case the control unit 44 triggers the ink kit 42 if the sensor 26 detects a rotary motion of the winding drum 1.

Figure 3:
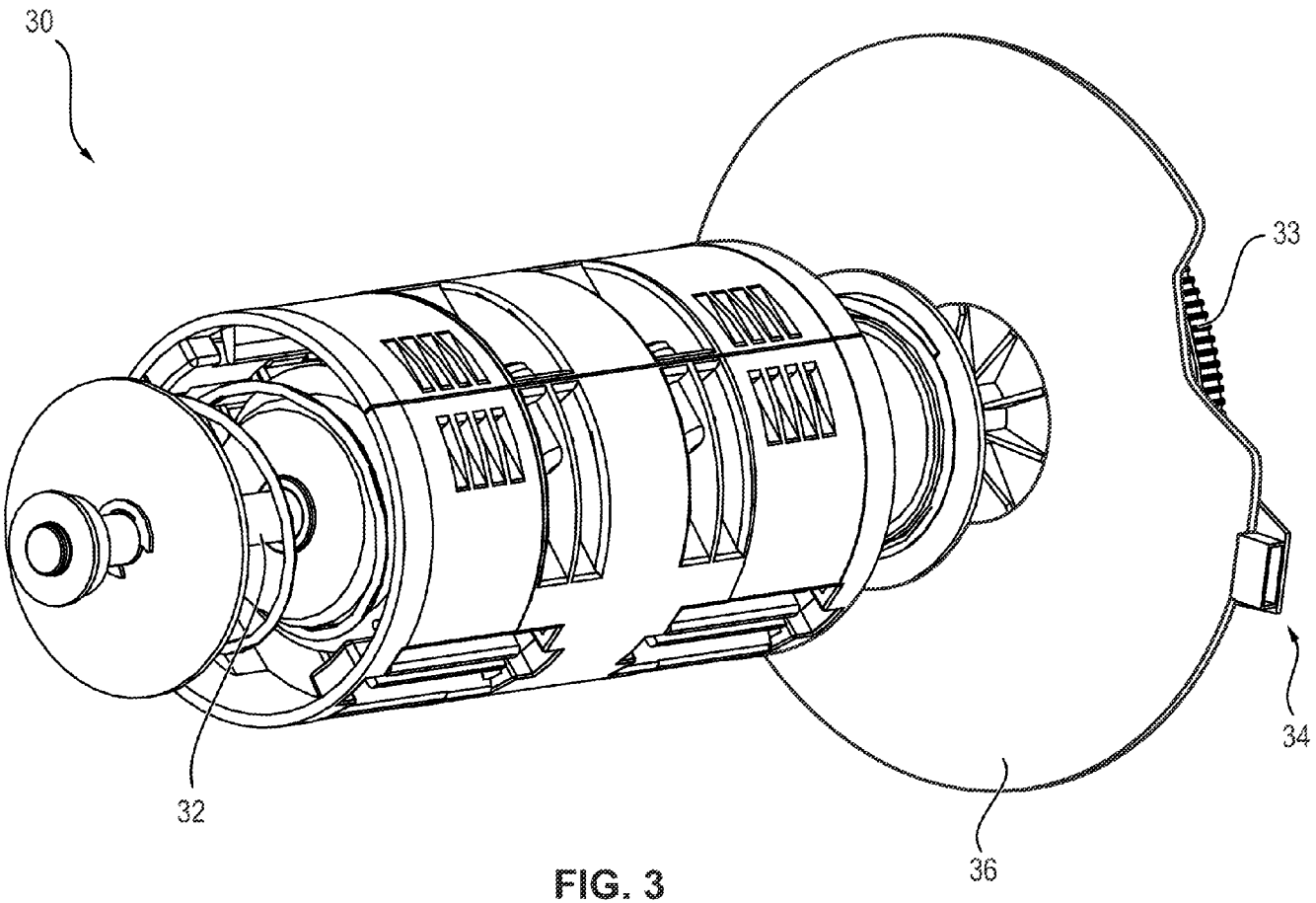
FIG. 3 is a schematic perspective view of a winding drum of a roller storage according to a further embodiment of the invention.
Figure 4:
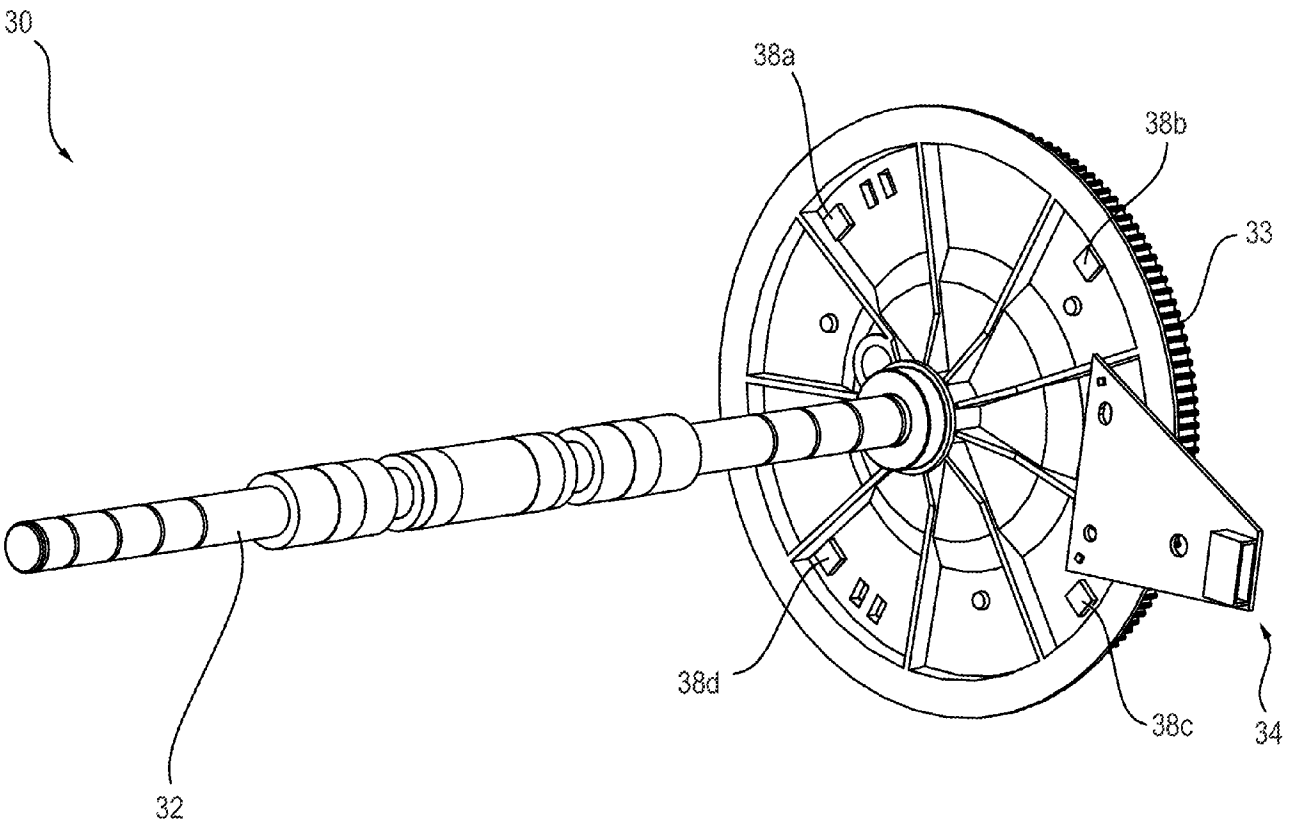
FIG. 4 is a schematic perspective view of a detail of the winding drum according to FIG. 3.

In FIG. 3 a schematic perspective view of a winding drum 30 of a transportable roller storage according to another embodiment of the invention is shown. In FIG. 4 a schematic perspective view of a detail of the winding drum 30 according to FIG. 3 is shown wherein of the winding drum 30 only the main shaft 32 and a gear wheel 33 fixed for rotation with the main shaft 32 as well as a Hall sensor unit 34 are shown.

The Hall sensor unit 34 is firmly attached to a stationary disk 36. The disk 36 does not rotate when the winding drum 30 rotates. On the gear wheel 33 in total four magnets 38*a* through 38*d* are arranged which are firmly connected to the gear wheel 33. The magnets 38*a* through 38*a* rotate when the winding drum 30 rotates so that a rotary motion of the winding drum 30 is easy to detect by means of the Hall sensor unit 34. As described above in connection with FIGS. 1 and 2, in dependence on the state of the transportable roller storage, an invalidating unit 42 is triggered or not if the Hall sensor unit 34 detects a rotary motion of the winding drum 30.

In an alternative embodiment of the invention more than four magnets 38*a* through 38*d* or less than four magnets 38*a* through 38*d* may be attached to the gear wheel 33.

Figure 5:
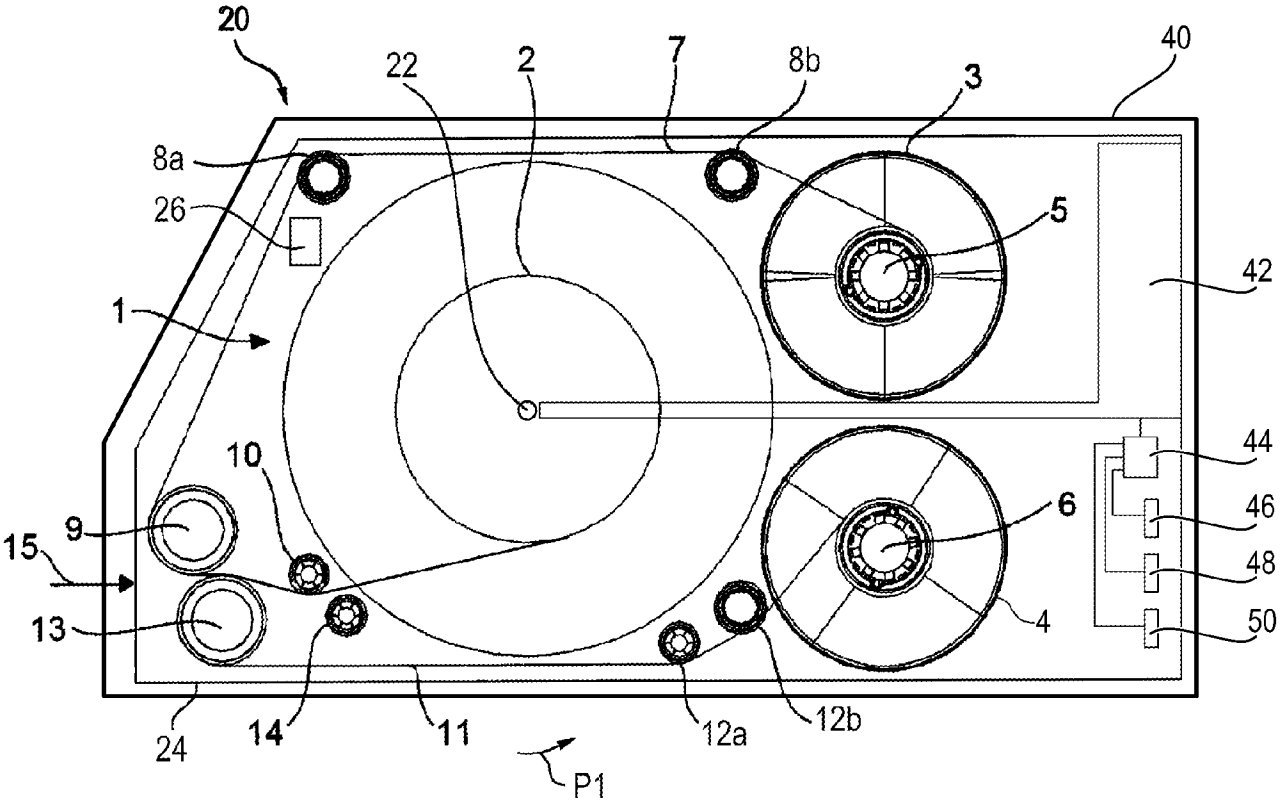
FIG. 5 is a schematic illustration of the roller storage of FIG. 1 received within a cash box.

The roller storage 20 and the sensors 26, 34, 44, 46, 48 can be received in a cash box 40, as shown in FIG. 5.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for at least one of transport and storage of notes of value comprising:

a roller storage having a winding drum for storing the notes of value;

a sensor configured to detect rotational movement of the winding drum;

an invalidating unit configured to invalidate the stored notes of value, the invalidating unit including an ink kit for dyeing the stored notes of value; and a control unit configured to control the invalidating unit;

wherein the control unit triggers the invalidating unit if the sensor has detected a rotary motion of the winding drum.

2. The device according to claim 1, wherein the winding drum is supported by a shaft so as to be rotatable about the longitudinal axis of the shaft, and that the sensor detects a rotary motion of the shaft.

3. The device according to claim 1, wherein the control unit in an activated mode triggers the invalidating unit if the sensor has detected a rotary motion of the winding drum, and that the control unit in a deactivated mode does not trigger the invalidating unit if the sensor has detected a rotary motion of the winding drum.

4. The device according to claim 1, wherein the control unit in an activated mode triggers the invalidating unit if the sensor has detected a rotary motion of the winding drum, and that in a deactivated mode of the sensor the sensor is deactivated so that it does not detect any rotary motion of the winding drum.

5. The device according to claim 1, wherein the control unit triggers the invalidating unit only if the sensor detects a rotary motion of the winding drum in an unwinding direction, with the unwinding direction being the rotating direction of the winding drum, in which it must be rotated for removal of stored notes of value.

6. The device according to claim 1, wherein the device includes at least one of the following: a position sensor for detecting the change in orientation of the device, an acceleration sensor for detecting the acceleration of the device, and a shock sensor for detecting shock-like loads acting on the device;

wherein stored within a memory area of a memory element is at least one of a preset maximum permissible threshold value for the change in orientation, a threshold for the acceleration, and a threshold for the shock-like load;

wherein the control unit after detection of at least one of a change in orientation, an acceleration, and a shock-like load compares the values detected with the respective threshold value;

wherein the control unit, if at least one determined value exceeds the respective threshold value, stores data, and that the control unit triggers the invalidating unit if the sensor detects a rotary motion of the winding drum within a preset period after the threshold value was exceeded.

7. The device according to claim 6, wherein the preset period is a first period, and that the control unit triggers the invalidating unit only if the control unit has determined that within a preset second period a threshold value was exceeded at least with a preset frequency.

8. The device according to claim 1, wherein the sensor comprises a Hall sensor.

9. The device according to claim 1, wherein the device comprises a cash box in which the roller storage and the sensor are received.

10. A cash box wherein it comprises a device according to claim 1.

11. A transportable roller storage device configured to receive, store, and dispense notes of value, the device comprising:

a winding drum including a winding core which the notes of value are wound onto and off of, the winding drum rotatable in a winding direction to wind the notes of value onto the winding drum, and an unwinding direction to unwind the notes of value off of the winding drum;

a shaft on which the winding drum is supported, the winding drum rotatable about a longitudinal axis of the shaft;

a rotational sensor configured to detect rotational movement of the winding drum in the winding direction and the unwinding direction;

an ink kit configured to dye the notes of value stored on the winding drum; and a control unit configured to activate the ink kit to dye the notes of value stored on the winding drum when the rotational sensor detects rotational movement of the winding drum in the unwinding direction, and configured to not activate the ink kit when the rotational sensor detects rotational movement of the winding drum in the winding direction.

12. The transportable roller storage device of claim 11, wherein the control unit is further configured to not activate the ink kit when the transportable roller storage device is coupled to an automated teller machine, an automatic cash register system, an automatic cash safe, or a docking station configured to load or unload notes of value from the transportable roller storage device.

13. The transportable roller storage device of claim 11, further comprising a position sensor configured to detect a change in orientation of the transportable roller storage device;

wherein the control unit is configured to not activate the ink kit unless the change in orientation of the transportable roller storage device detected by the position sensor exceeds a predetermined threshold.

14. The transportable roller storage device of claim 11, further comprising an acceleration sensor configured to detect acceleration of the transportable roller storage device;

wherein the control unit is configured to not activate the ink kit unless acceleration of the transportable roller storage device detected by the acceleration sensor exceeds a predetermined threshold.

15. The transportable roller storage device of claim 11, further comprising a shock sensor configured to detect a shock load acting on the transportable roller storage device;

wherein the control unit is configured to not activate the ink kit unless shock load acting on the transportable roller storage device detected by the shock sensor exceeds a predetermined threshold.

* * * * *